US011064305B2

(12) United States Patent
Ruefenacht et al.

(10) Patent No.: US 11,064,305 B2
(45) Date of Patent: Jul. 13, 2021

(54) SYSTEMS AND METHODS FOR USING A SELECTIVELY CONFIGURABLE INTERFACE ASSEMBLY TO PROGRAM A HEARING DEVICE

(71) Applicant: SONOVA AG, Staefa (CH)

(72) Inventors: Marius Ruefenacht, Volketswil (CH); Fethi Cherigui, Adliswil (CH)

(73) Assignee: Sonova AG, Staefa (CH)

( * ) Notice: Subject to any disclaimer, the term of this patent is extended or adjusted under 35 U.S.C. 154(b) by 121 days.

(21) Appl. No.: 16/588,333

(22) Filed: Sep. 30, 2019

(65) Prior Publication Data

US 2021/0099816 A1 Apr. 1, 2021

(51) Int. Cl.
*H04R 25/00* (2006.01)

(52) U.S. Cl.
CPC ..... *H04R 25/70* (2013.01); *H04R 25/30* (2013.01); *H04R 25/558* (2013.01); *H04R 2225/023* (2013.01); *H04R 2225/55* (2013.01)

(58) Field of Classification Search
CPC ..... H04R 25/70; H04R 25/30; H04R 25/558; H04R 2225/023; H04R 2225/55
USPC ..... 381/314
See application file for complete search history.

(56) References Cited

U.S. PATENT DOCUMENTS

| | | | | |
|---|---|---|---|---|
| 7,946,890 | B1 | 5/2011 | Bondo et al. | |
| 9,615,180 | B2 | 4/2017 | Hartley | |
| 10,743,118 | B2 * | 8/2020 | Moller | H04R 25/554 |
| 2004/0138723 | A1 * | 7/2004 | Malick | H04R 25/552 607/57 |
| 2012/0082331 | A1 * | 4/2012 | Meosky | H04R 25/607 381/323 |
| 2012/0109297 | A1 * | 5/2012 | Van den Heuvel | H04R 25/606 623/10 |
| 2016/0296755 | A1 * | 10/2016 | Van Der Borght | A61N 1/36038 |

* cited by examiner

*Primary Examiner* — Sean H Nguyen
(74) *Attorney, Agent, or Firm* — ALG Intellectual Property, LLC

(57) ABSTRACT

An exemplary hearing device includes an interface assembly comprising a plurality of contacts and a processor coupled to the contacts. The processor is configured to configure, while a receiver assembly is connected to the interface assembly, the contacts to serve as output contacts; output, based on the configuring, audio signals to the receiver assembly by way of the contacts; detect that a device has been connected to the interface assembly in place of the receiver assembly; measure, in response to the detecting, a direct current resistance (DCR) of the device; determine, based on the DCR, that the device is a programming device; reconfigure, in response to determining that the device is the programming device, the contacts to serve as input contacts; and receive, based on the reconfiguring of the contacts to serve as input contacts, programming instructions from the programming device by way of the contacts.

20 Claims, 6 Drawing Sheets

SYSTEMS AND METHODS FOR USING A SELECTIVELY CONFIGURABLE INTERFACE ASSEMBLY TO PROGRAM A HEARING DEVICE

BACKGROUND INFORMATION

Hearing devices are often programmed during production, fitting, and service processes. To this end, a conventional hearing device includes a dedicated wired interface configured to facilitate communicative coupling of a programing device with the hearing device. Unfortunately, this may necessitate additional interfaces being included in the hearing device to facilitate communication by the hearing device with other types of external devices. For example, a conventional hearing device configured to be selectively coupled to a receiver assembly also includes a separate wired interface for the receiver assembly. This may disadvantageously affect the size and/or reliability of the hearing device.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Systems and methods for using a selectively configurable interface assembly to program a hearing device are described herein. For example, a hearing device configured to be worn by a user may include an interface assembly comprising a plurality of contacts and a processor communicatively coupled to the plurality of contacts. The processor may be configured to configure, while a receiver assembly is connected to the interface assembly, the contacts to serve as output contacts. While the contacts are configured to serve as output contacts, the processor may output audio signals to the receiver assembly by way of the contacts. The processor may be further configured to detect that a device has been connected to the interface assembly in place of the receiver assembly. In response, the processor may measure an electrical characteristic of the device and determine, based on the electrical characteristic of the device, that the device is a programming device. In response to determining that the device is the programming device, the processor may reconfigure the contacts to serve as input contacts and receive, based on the reconfiguring of the contacts to serve as input contacts, programming instructions from the programming device by way of the contacts. In some examples, as described herein, the programing instructions include code configured to update a firmware and/or a fitting configuration, e.g., a personalized parameter setting, of the hearing device. In these examples, the processor may be further configured to update, based on the code, the firmware and/or the fitting configuration of the hearing device.

The systems, hearing devices, and methods described herein may advantageously provide many benefits to both users and manufacturers of hearing devices. For example, the systems, hearing devices, and methods described herein may allow a hearing device to use a single interface for both a receiver assembly and a programming device. By reducing a number of interfaces needed on the hearing device, a design of the hearing device may be simplified, reducing hardware cost and complexity compared to a conventional hearing device. The systems, hearing devices, and methods described herein may also advantageously increase performance, reliability, and ease of use for hearing device users. These and other benefits of the systems, hearing devices, and methods described will be made apparent herein.

Figure 1:
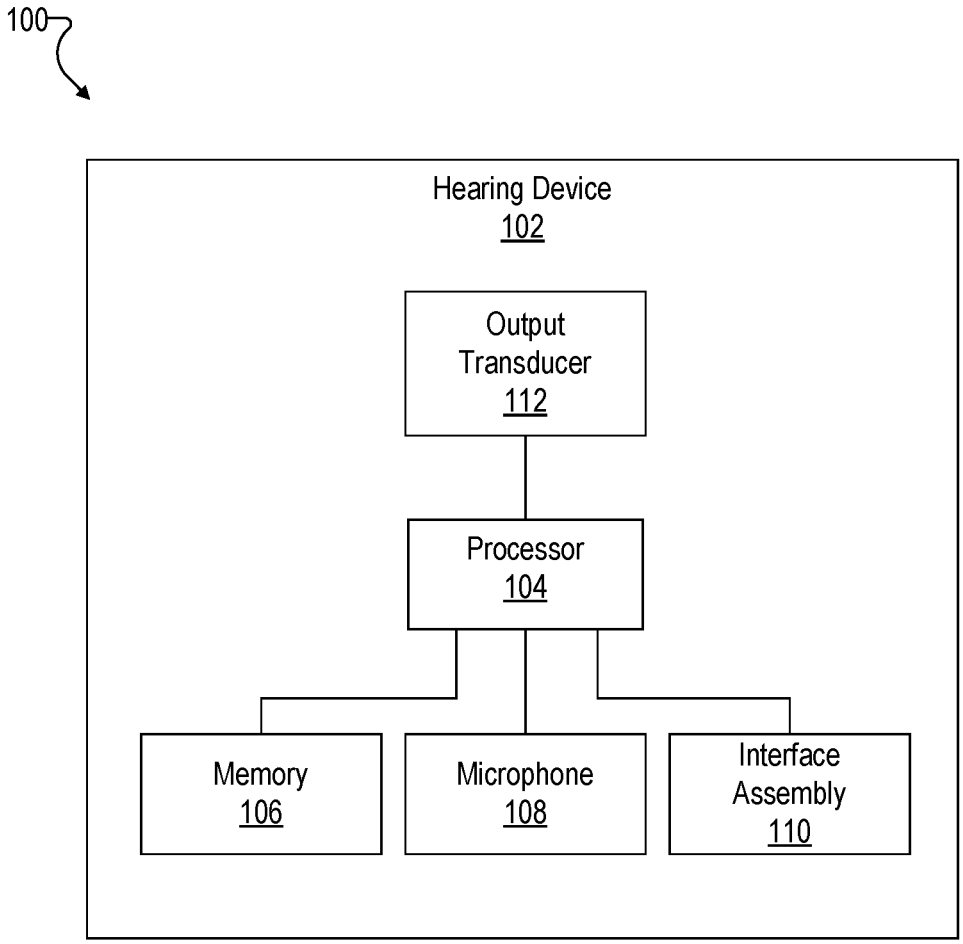
FIGS. 1, 2A, and 2B show exemplary configurations of a hearing device according to principles described herein.

FIG. 1 shows an exemplary configuration of a hearing device 102. Hearing device 102 may be implemented by any type of device configured to provide or enhance hearing to a user. For example, hearing device 102 may be implemented by a hearing aid configured to provide an audible signal (e.g., amplified audio content) to a user, a sound processor included in a system configured to apply both acoustic and electrical stimulation representative of audio content to a user, a receiver-in-canal (RIC) hearing device, or any other suitable hearing prosthesis. As shown, hearing device 102 includes a processor 104 communicatively coupled to a memory 106, a microphone 108, an interface assembly 110, and an output transducer 112. Hearing device 102 may include additional or alternative components as may serve a particular implementation.

Microphone 108 may be implemented by any suitable audio detection device and is configured to detect audio content ambient to a user of hearing device 102. Microphone 108 may be included in or communicatively coupled to hearing device 102 in any suitable manner.

Interface assembly 110 may be implemented by any suitable interface comprising a plurality of contacts configured to connect to corresponding reciprocal contacts on any suitable external device. Example configurations of interface assembly 110 will be further described herein.

Output transducer 112 may be implemented by any suitable audio output device, such as a loudspeaker of a hearing device or an output electrode of a cochlear implant system. In some examples, output transducer 112 may be implemented, at least in part, by a receiver assembly external to hearing device 102 and connected via interface assembly 110.

Memory 106 may be implemented by any suitable type of storage medium and may be configured to maintain, e.g., store, data generated, accessed, or otherwise used by processor 104. For example, memory 106 may maintain programming instructions (e.g., code, firmware instructions), hearing loss compensation data, audio processing data, parameter setting data, etc. Memory 106 may be implemented by random-access memory (RAM), read-only memory (ROM), and/or any other type of memory.

Processor 104 may be configured to perform various processing operations, such as receiving and processing audio content, output by a receiver and communicating with a programming device to update software, firmware, fitting configurations (e.g., parameters, etc.), etc. on hearing device 102. Examples of audio content may include audio content from microphone 108, from another device providing an audio stream, etc. Processor 104 may be configured to also perform processing operations to determine a type of device connected to hearing device 102 and reconfiguring contacts of interface assembly 110 based on the determination. Processor 104 may be implemented by any suitable combination of hardware and software. In the description that follows, any references to operations performed by hearing device 102 may be understood to be performed by processor 104 of hearing device 102.

Figure 2B:
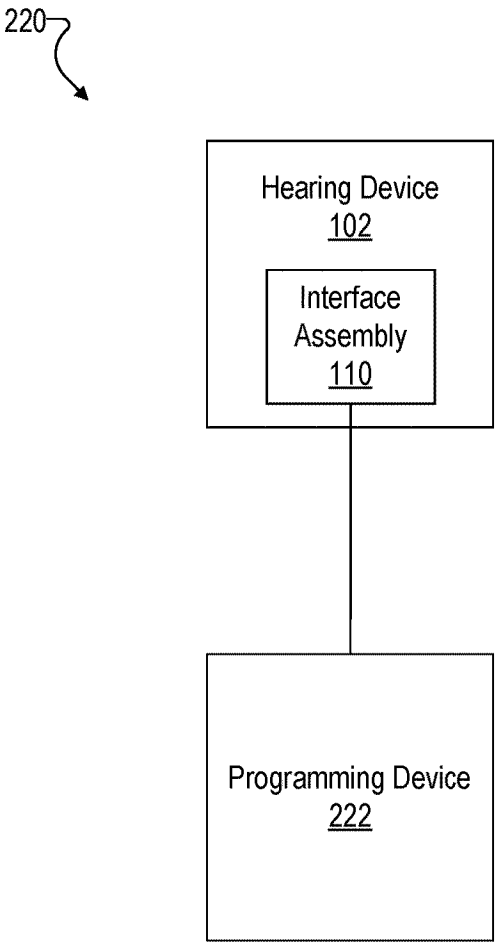
Figure 2A:
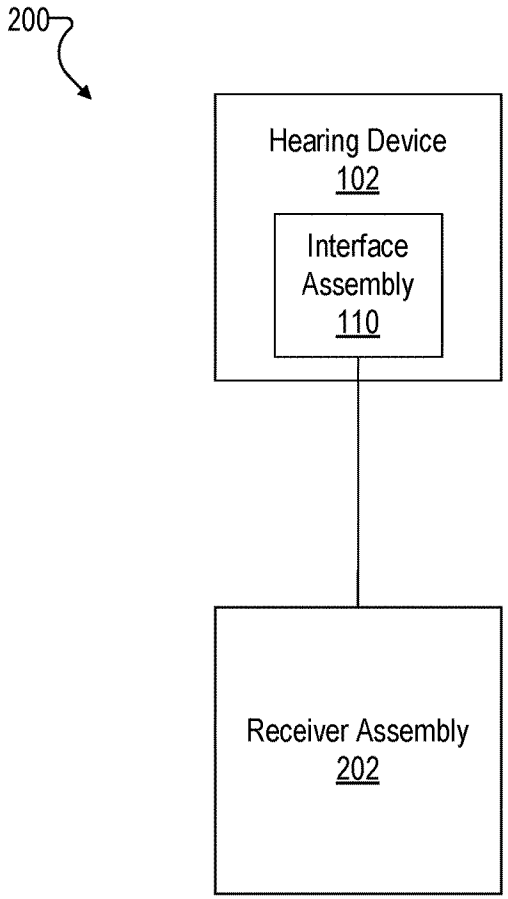

FIG. 2A shows an exemplary configuration 200 of hearing device 102, connected to a receiver assembly 202. Receiver assembly 202 is connected to hearing device 102 via interface assembly 110. Receiver assembly 202 may be any suitable receiver component and/or device configured to output audio signals to a user of hearing device 102.

Interface assembly 110 is configured to interchangeably connect to a plurality of external devices and/or components. For example, interface assembly 110 may connect to receiver assembly 202, as shown, as well as a programming device, a sensor component (e.g., a sensor-in-canal device), a microphone assembly, a user control device, a charger for hearing device 102, and/or any other component as may serve a particular implementation.

To facilitate such interchangeable connectivity, interface assembly 110 may include a plurality of contacts, e.g., pins, conductive receptacles, etc. For example, interface assembly 110 may include three, four, six, or any suitable number of contacts. Hearing device 102 may selectively configure the contacts of interface assembly 110 to serve as output contacts to provide audio signals to be output by receiver assembly 202. Example contact configurations are further described herein.

FIG. 2B shows another exemplary configuration 220 of hearing device 102, connected to a programming device 222. Programming device 222 is connected to hearing device 102 via interface assembly 110, in place of receiver assembly 202. Programming device 222 may be any suitable device that is configured to provide programming instructions, such as a computing device, a processor, an embedded programming I2C (inter-integrated circuit) peripheral, or any other such device. Examples of programming instructions may include code, firmware instructions, fitting configuration instructions, etc.

As programming device 222 is connected to interface assembly 110 in place of receiver assembly 202, hearing device 102 may reconfigure the contacts on interface assembly 110 to communicate with programming device 222. For example, for an I2C peripheral, programming device 222 may use four contacts (e.g., power, ground, data, and clock) to provide instructions to hearing device 102. Alternatively, programming device 222 may use three contacts (e.g., ground, data, and clock) and receive power from another source. Example contact configurations are described herein.

Hearing device 102 may be configured to determine what type of device is connected to interface assembly 110 to appropriately configure the contacts of interface assembly 110. Hearing device 102 may determine the type of device connected in any suitable manner. For example, hearing device 102 may determine the type of device based on a measuring of one or more electrical characteristics of the device. For instance, hearing device 102 may measure a direct current (DC) resistance (DCR) of the device, an alternating current (AC) resistance of the device, a complex impedance of the device, an electrical signal transmitted by the device, and/or any other suitable electrical characteristics.

As an example, hearing device 102 may be configured to measure such characteristics during a bootup process of hearing device 102. During startup of hearing device 102, hearing device 102 may detect that the device has been connected to interface assembly 110. Additionally or alternatively, hearing device 102 may detect that the device has been connected to interface assembly 110 at any suitable time. For example, hearing device 102 may monitor for a connecting of the device subsequent to a detecting of a disconnecting of a previous external device. Additionally or alternatively, hearing device 102 may receive an input from a user indicating the connection of a device to interface assembly 110. Based on detecting that the device has been connected to interface assembly 110, hearing device 102 may measure the DCR of the device.

Based on the measured DCR, hearing device 102 may determine that the device is programming device 222. In this example, programming device 222 may exhibit a DCR similar to that of an open circuit, while a receiver assembly may exhibit specific DCR measurements based on a type of the receiver assembly. Thus hearing device 102 may use a threshold DCR, e.g., 400 ohms (Ω), 500Ω, or any other suitable threshold, to differentiate among external devices. If the measured DCR exceeds the threshold, hearing device 102 may determine that the device is programming device 222. As a result, hearing device 102 may reconfigure the contacts of interface assembly 110 to communicate with programming device 222, reconfiguring the contacts to serve as input contacts to receive programming instructions. Additionally, the contacts may also serve as output contacts and/or a digital data interface to communicate with programming device 222 while receiving the programming instructions. For instance, the programming instructions may include code configured to update a firmware and/or a fitting configuration of hearing device 102, and hearing device 102 may update the firmware and/or the fitting configuration based on the received code.

In some examples, hearing device 102 may perform such operations on each startup, such that hearing device 102 may detect a receiver assembly (e.g., receiver assembly 202) in place of programming device 222 (e.g., by determining that a measured DCR of the device is below a threshold, such as 400Ω) and vice versa. Additionally, based on determining that the measured DCR is below the threshold, hearing device 102 may measure additional characteristics and/or use specific DCR measurements to determine a type of external device that is connected. For example, hearing device 102 may differentiate among different models of receiver assemblies based on the measured DCR and additional measurements such as an AC impedance of the external device. Alternatively, hearing device 102 may determine that the external device is a sensor-in-canal device, a microphone, etc. based on the measured DCR and additional measurements. Additionally or alternatively, additional measurements such as an AC impedance of the external device may provide additional information about the external device and/or an environment of the external device. For instance, the measured AC impedance of a receiver assembly may indicate a blockage of an audio output of the AC impedance, such as by debris, cerumen buildup, etc.

Furthermore, hearing device 102 may be configured to default to configuring the contacts of interface assembly 110 to communicate with programming device 222 if a receiver assembly is not detected or for any other indeterminate configuration is detected. Such a default configuration may be implemented by storing instructions for configuring the contacts of interface assembly 110 in a ROM of hearing device 102. Configuring hearing device 102 to default to communicating with programming device 222 may facilitate debugging hearing device 102, for example, if software on hearing device 102 becomes corrupted during use. In some examples, such debugging and/or programming procedures may include updating firmware on hearing device 102.

Figure 3:
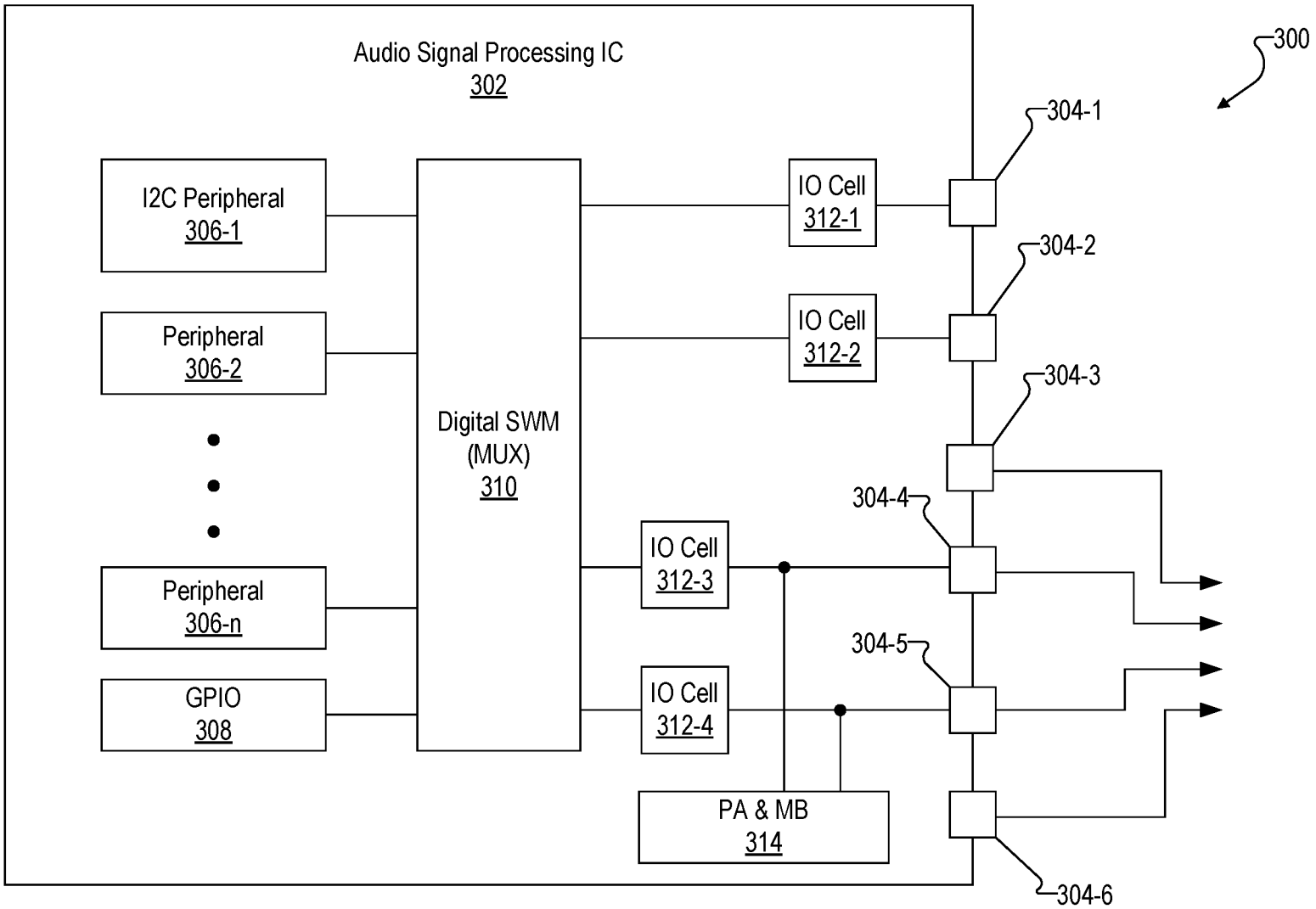
FIGS. 3 and 4 illustrate exemplary configurations of an interface assembly of a hearing device according to principles described herein.

FIG. 3 illustrates an exemplary configuration 300 of an interface assembly (e.g., interface assembly 110) of a hearing device (e.g., hearing device 102). As shown, configuration 300 includes an audio signal processing integrated circuit (IC) 302 that includes contacts 304 (e.g., contacts 304-1 through 304-6) that are configured by audio signal processing IC 302 to interchangeably connect to external devices, such as a receiver or a programming device. Audio signal processing IC 302 also includes peripheral circuits 306, such as an I2C peripheral circuit 306-1 and other peripheral circuits 306-2 through **306-*n*. Audio signal processing IC 302 also includes a general purpose input/output (GPIO) circuit 308. Peripheral circuits 306 and GPIO circuit 308 are connected to contacts 304 via a digital switch multiplexer 310 ("MUX 310") and input/output (IO) cells 312 (IO cells 312-1 through 312-4). Audio signal processing IC 302 also includes a power amplifier and measurement bridge circuit 314 configured to measure one or more characteristics of devices that are connected to the audio signal processing IC 302**.

For example, during a bootup process of the hearing device or at any other suitable time, audio signal processing IC 302 may use power amplifier and measurement bridge circuit 314 to measure one or more characteristics of a device connected to audio signal processing IC 302 via contacts 304. Power amplifier and measurement bridge circuit 314 may be used to measure characteristics such as DCR, AC impedance, and/or any other suitable characteristics. Configuration 300 shows power amplifier and measurement bridge circuit 314 configured to measure the characteristics across contacts 304-4 and 304-5, which may be configured to serve as a first output (e.g., a positive output OUTP) and a second output (e.g., a negative output OUTN) for an external device. While configuration 300 shows measurement bridge 314 connected to contacts 304-4 and 304-5, power amplifier and measurement bridge circuit 314 may alternatively or additionally be connected to other contacts to measure characteristics of external devices.

Contacts 304-3 through 304-6 may be configured to interchangeably connect to external devices including a receiver and a programming device. For example, contact 304-3 may be configured to provide power, such as from a battery of the hearing device or other such voltage source. Contact 304-6 may be configured to provide a ground. Contact 304-4 and contact 304-5 may be analog IOs that can be reconfigured as digital general purpose IOs depending on the type of external device connected to the interface assembly. For instance, if audio signal processing IC 302 detects that a receiver assembly is connected to the interface assembly, contact 304-4 may serve as an OUTP output and contact 304-5 as an OUTN output to provide audio signals to the receiver assembly. If audio signal processing IC 302 detects that a programming device is connected to the interface assembly, contact 304-4 may serve as a serial clock line (SCL) and contact 304-5 may serve as a serial data line (SDA) to communicate with the programming device.

As described previously, the hearing device may include instructions for configuring the interface assembly, such as in a ROM of the hearing device. During the bootup process, the hearing device may execute the instructions in the ROM to connect contacts 304-4 and 304-5 to power amplifier and measurement bridge circuit 314. The hearing device may perform a measurement of characteristics (e.g., DCR) of the connected device. Based on the measured DCR, the hearing device may configure contacts 304. For instance, if the DCR exceeds a threshold (e.g. 400Ω), the hearing device may reconfigure contacts 304-4 and 304-5 to serve as digital data IO contacts to communicate with a programming device. The hearing device may configure MUX 310 to connect contacts 304-4 and 304-5 to I2C peripheral circuit 306-1. If the DCR does not exceed the threshold, the hearing device may keep contacts 304-4 and 304-5 connected to power amplifier and measurement bridge circuit 314, through which the hearing device may provide audio signals to be output to a receiver assembly.

Additionally, contacts 304-1 and 304-2 may conventionally be configured to connect a programming device directly to I2C peripheral circuit 306-1. However, as audio signal processing IC 302 is configured to reconfigure contacts 304-3 through 304-6 to connect to the programming device, contacts 304-1 and 304-2 may be repurposed to be used as general purpose IO contacts. Using contacts 304-1 and 304-2 as general purpose IO contacts may allow for connectivity to more types of devices than with a conventional interface assembly. Additionally or alternatively, contacts 304-1 and 304-2 and/or additional contacts not shown may be used to allow audio signal processing IC 302 to connect to a plurality of devices simultaneously. For instance, audio signal processing IC 302 may connect to a combination device that includes both a receiver and a microphone. Additional contacts may allow audio signal processing IC 302 to detect types of multiple external devices simultaneously.

Figure 4:
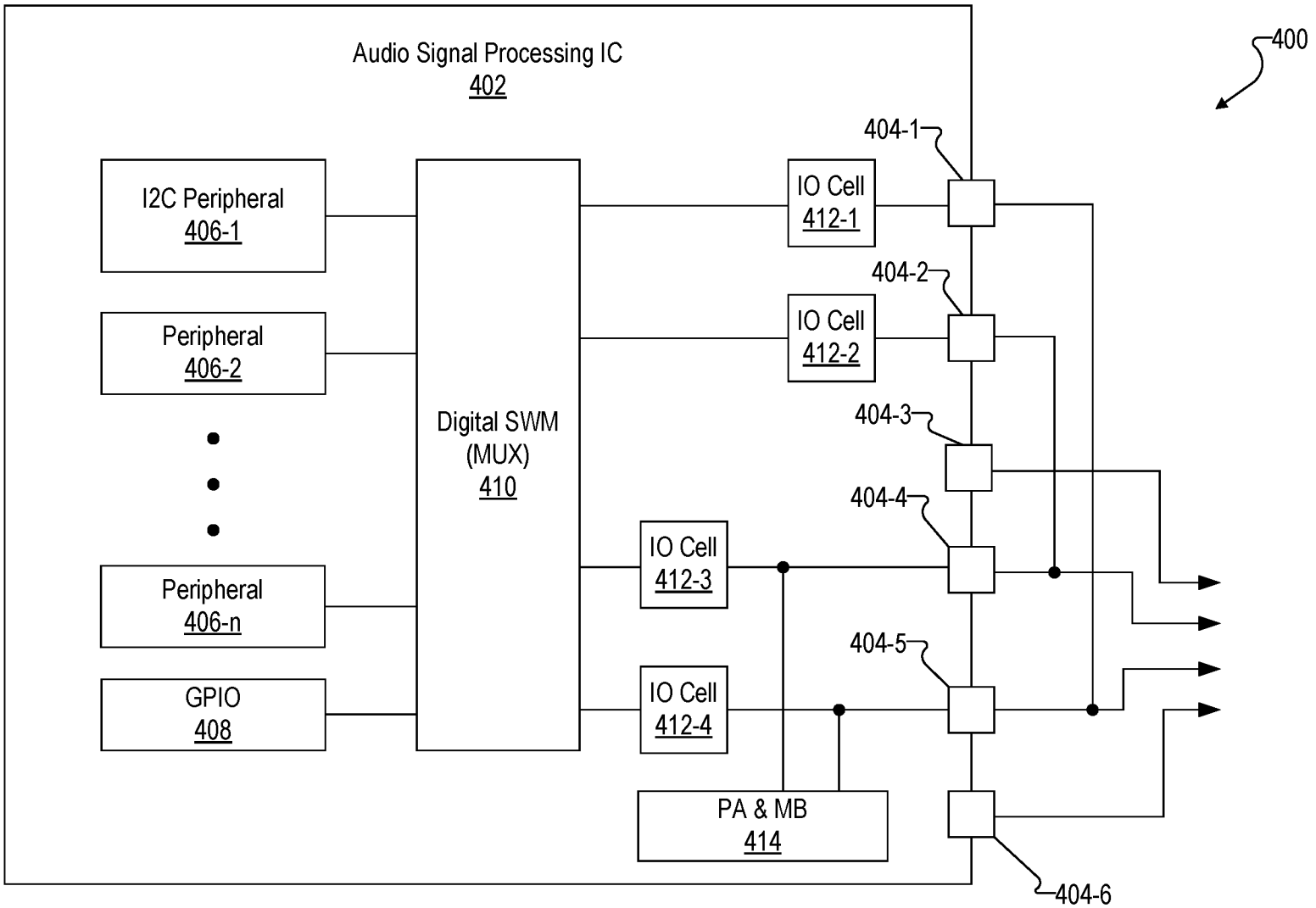

FIG. 4 illustrates another exemplary configuration 400 of an interface assembly (e.g., interface assembly 110) of a hearing device (e.g., hearing device 102). Similar to configuration 300, configuration 400 includes an audio signal processing integrated circuit (IC) 402. Audio signal processing IC 402 includes contacts 404 (e.g., contacts 404-1 through 404-6) that are configured by audio signal processing IC 402 to interchangeably connect to external devices, such as a receiver or a programming device. Audio signal processing IC 402 also includes peripheral circuits 406, such as an I2C peripheral circuit 406-1 and other peripheral circuits 406-2 through **406-*n*. Audio signal processing IC 402 also includes a general purpose input/output (GPIO) circuit 408. Peripheral circuits 406 and GPIO circuit 408 are connected to contacts 404 via a digital switch multiplexer 410 ("MUX 410") and input/output (IO) cells 412 (IO cells 412-1 through 412-4). Audio signal processing IC 402 also includes a power amplifier and measurement bridge circuit 414 configured to measure one or more characteristics of devices that are connected to the audio signal processing IC 402**.

As with configuration 300, during a bootup process of the hearing device, audio signal processing IC 402 may use power amplifier and measurement bridge circuit 414 to measure one or more characteristics of a device connected to audio signal processing IC 402 via contacts 404 to determine a type of device connected to audio signal processing IC 402. For example, the hearing device may initially disconnect contact 404-1 and contact 404-2 from I2C peripheral circuit 406-1 and put contacts 404-1 and 404-2 in a high-impedance mode. The hearing device may then connect contact 404-4 and contact 404-5 to power amplifier and measurement bridge circuit 414. The hearing device may measure a DCR of a connected device, and based on the DCR, the hearing device may configure contacts 404. For instance, if the DCR exceeds a threshold (e.g. 400Ω), the hearing device may disconnect contacts 404-4 and 404-5 from power amplifier and measurement bridge 414 and put contacts 404-4 and 404-5 in a high-impedance mode. The hearing device may also connect contacts 404-1 and 404-2 to I2C peripheral circuit 406-1 via MUX 410. If the DCR does not exceed the threshold, the hearing device may keep contacts 404-4 and 404-5 connected to power amplifier and measurement bridge circuit 414, through which the hearing device may provide audio signals to be output to a receiver assembly. The hearing device may also keep contacts 404-1 and 404-2 in high-impedance mode.

Figure 5:
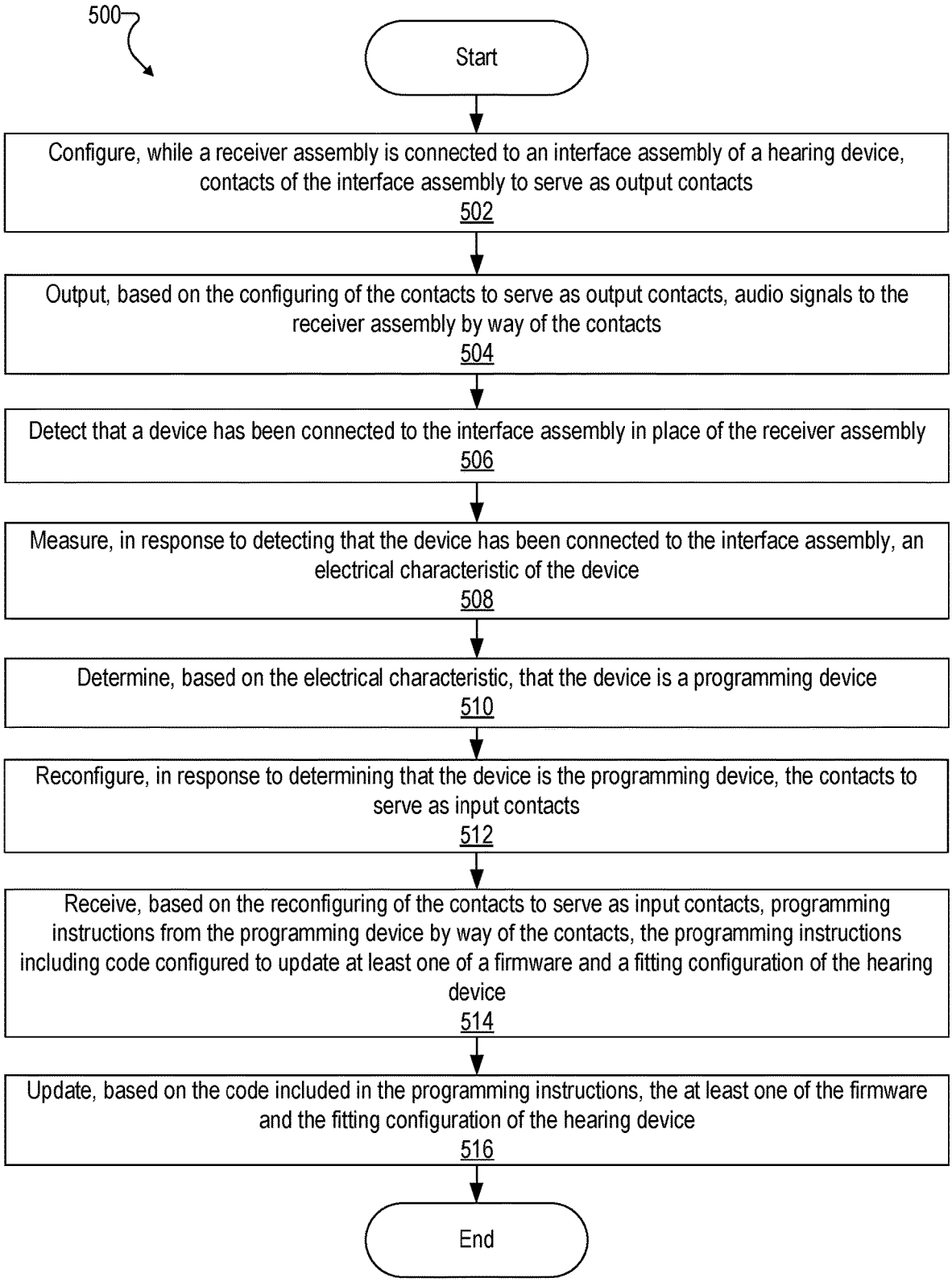
FIGS. 5 and 6 illustrate exemplary methods according to principles described herein.

FIG. 5 illustrates an exemplary method 500. One or more of the operations shown in FIG. 5 may be performed by any of the hearing devices described herein. While FIG. 5 illustrates exemplary operations according to one embodiment, other embodiments may omit, add to, reorder, and/or modify any of the operations shown in FIG. 5.

In step 502, a hearing device configures, while a receiver assembly is connected to an interface assembly of the hearing device, contacts of the interface assembly to serve as output contacts. Step 502 may be performed in any of the ways described herein.

In step 504, the hearing device outputs, based on the configuring of the contacts to serve as output contacts, audio signals to the receiver assembly by way of the contacts. Step 504 may be performed in any of the ways described herein.

In step 506, the hearing device detects that a device has been connected to the interface assembly in place of the receiver assembly. Step 506 may be performed in any of the ways described herein.

In step 508, the hearing device measures, in response to detecting that the device has been connected to the interface assembly, an electrical characteristic of the device. Step 508 may be performed in any of the ways described herein.

In step 510, a hearing device determines, based on the electrical characteristic, that the device is a programming device. Step 510 may be performed in any of the ways described herein.

In step 512, the hearing device reconfigures, in response to determining that the device is the programming device, the contacts to serve as input contacts. Step 512 may be performed in any of the ways described herein.

In step 514, the hearing device receives, based on the reconfiguring of the contacts to serve as input contacts, programming instructions from the programming device by way of the contacts, the programming instructions including code configured to update at least one of a firmware and a fitting configuration of the hearing device. Step 514 may be performed in any of the ways described herein.

In step 516, the hearing device update, based on the code included in the programming instructions, the at least one of the firmware and the fitting configuration of the hearing device. Step 516 may be performed in any of the ways described herein.

Figure 6:
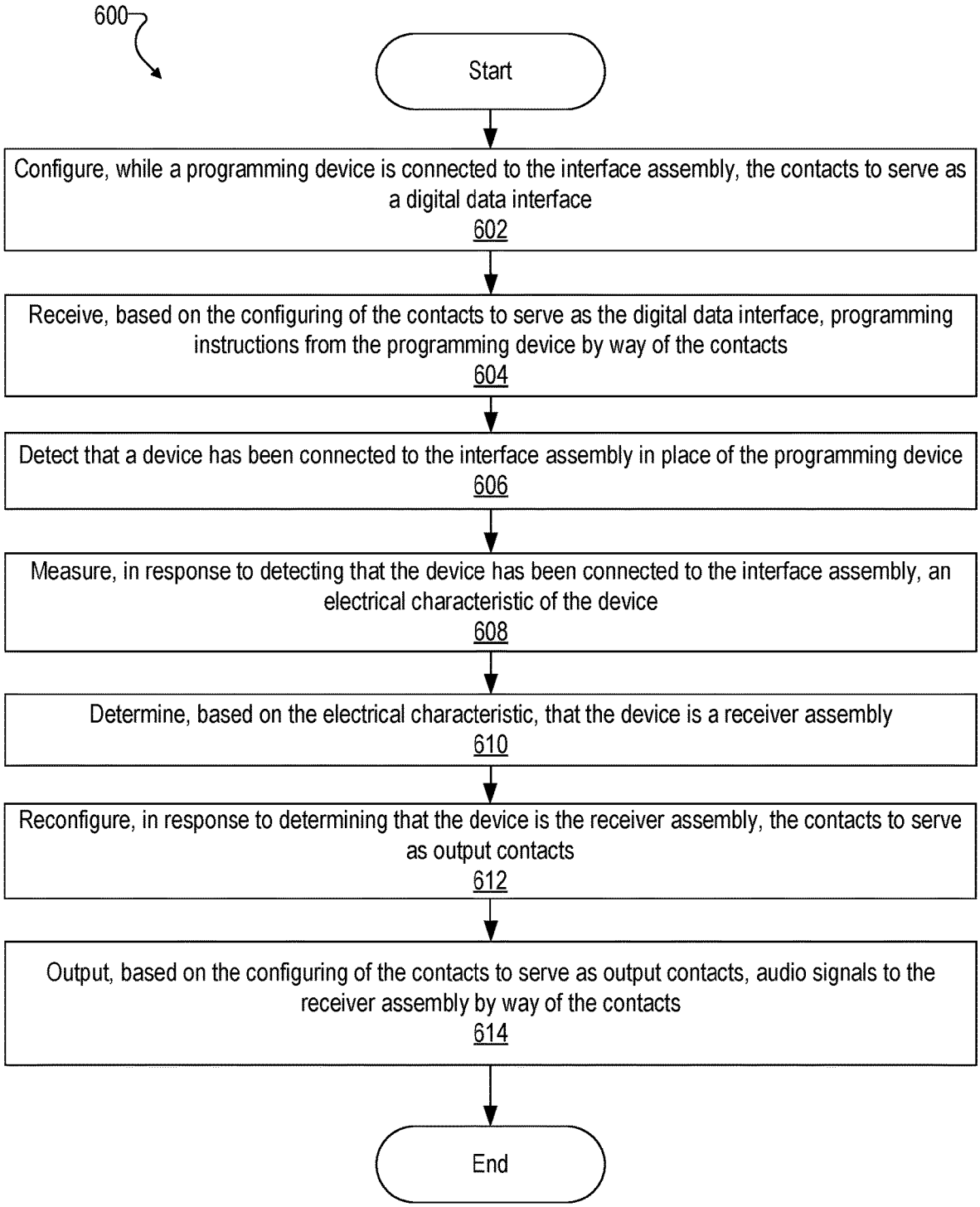

FIG. 6 illustrates an exemplary method 600. One or more of the operations shown in FIG. 6 may be performed by any of the hearing devices described herein. While FIG. 6 illustrates exemplary operations according to one embodiment, other embodiments may omit, add to, reorder, and/or modify any of the operations shown in FIG. 6.

In step 602, a hearing device configures, while a programming device is connected to an interface assembly of the hearing device, contacts of the interface assembly to serve as a digital data interface. Step 602 may be performed in any of the ways described herein.

In step 604, the hearing device receives, based on the configuring of the contacts to serve as the digital data interface, programming instructions from the programming device by way of the contacts. Step 604 may be performed in any of the ways described herein.

In step 606, the hearing device detects that a device has been connected to the interface assembly in place of the programming device. Step 606 may be performed in any of the ways described herein.

In step 608, the hearing device measures, in response to detecting that the device has been connected to the interface assembly, an electrical characteristic of the device. Step 608 may be performed in any of the ways described herein.

In step 610, a hearing device determines, based on the electrical characteristic, that the device is a receiver assembly. Step 610 may be performed in any of the ways described herein.

In step 612, the hearing device reconfigures, in response to determining that the device is the receiver assembly, the contacts to serve as output contacts. Step 612 may be performed in any of the ways described herein.

In step 614, the hearing device outputs, based on the configuring of the contacts to serve as output contacts, audio signals to the receiver assembly by way of the contacts. Step 614 may be performed in any of the ways described herein.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing device comprising:

an interface assembly comprising a plurality of contacts;

a memory storing instructions; and a processor communicatively coupled to the plurality of contacts and the memory, the processor configured to execute the instructions to:

configure while a receiver assembly is connected to the interface assembly, the contacts to serve as output contacts;

output, based on the configuring of the contacts to serve as output contacts, audio signals to the receiver assembly by way of the contacts;

detect that a device has been connected to the interface assembly in place of the receiver assembly;

measure, in response to detecting that the device has been connected to the interface assembly, an electrical characteristic of the device;

determine, based on the electrical characteristic, that the device is a programming device;

reconfigure, in response to determining that the device is the programming device, the contacts to serve as input contacts;

receive, based on the reconfiguring of the contacts to serve as input contacts, programming instructions from the programming device by way of the contacts, the programming instructions including code configured to update at least one of a firmware and a fitting configuration of the hearing device; and update, based on the code included in the programming instructions, the at least one of the firmware and the fitting configuration of the hearing device.

2. The hearing device of claim 1, wherein the electrical characteristic comprises at least one of a direct current resistance (DCR) of the device, an alternating current (AC)

resistance of the device, a complex impedance of the device, and an electrical signal transmitted by the device.

3. The hearing device of claim 1, wherein:

the configuring the contacts to serve as output contacts comprises configuring the contacts to serve as analog output contacts; and the reconfiguring the contacts to serve as input contacts comprises reconfiguring the contacts to serve as a digital data interface.

4. The hearing device of claim 1, wherein:

the processor is further configured to reboot the hearing device; and the detecting that the device has been connected occurs during a boot up phase of the hearing device.

5. The hearing device of claim 1, wherein the hearing device is a receiver-in-canal (RIC) hearing device.

6. The hearing device of claim 1, wherein the memory is a read-only memory (ROM).

7. A hearing device comprising:

an interface assembly comprising a plurality of contacts;

a processor communicatively coupled to the plurality of contacts and configured to:

configure, while a programming device is connected to the interface assembly, the contacts to serve as a digital data interface;

receive, based on the configuring of the contacts to serve as the digital data interface, programming instructions from the programming device by way of the contacts;

detect that a device has been connected to the interface assembly in place of the programming device;

measure, in response to detecting that the device has been connected to the interface assembly, a direct current resistance (DCR) of the device;

determine, based on the DCR, that the device is a receiver assembly;

reconfigure, in response to determining that the device is the receiver assembly, the contacts to serve as output contacts; and output, based on the configuring of the contacts to serve as output contacts, audio signals to the receiver assembly by way of the contacts.

8. The hearing device of claim 7, wherein the reconfiguring the contacts comprises reconfiguring the contacts to serve as analog output contacts.

9. The hearing device of claim 7, wherein the hearing device is a receiver in a canal (RIC) hearing device.

10. The hearing device of claim 7, wherein:

the processor is further configured to measure, in addition to the DCR of the device, an alternating current (AC) impedance of the device; and the determining that the device is the receiver assembly is further based on the AC impedance.

11. The hearing device of claim 7, wherein the processor is further configured to determine, based on the AC impedance, that an audio output of the receiver assembly is being blocked.

12. The hearing device of claim 7, wherein:

the processor is further configured to reboot the hearing device; and the detecting that the device has been connected occurs during a boot up phase of the hearing device.

13. The hearing device of claim 7, wherein the programming instructions from the programming device include code configured to update a firmware of the hearing device, and the processor is further configured to update, based on the code included in the programming instructions, the firmware of the hearing device.

14. A method comprising:

configuring, on a hearing device, while a receiver assembly is connected to an interface assembly of the hearing device, contacts of the interface assembly to serve as output contacts;

outputting, by the hearing device, based on the configuring of the contacts to serve as output contacts, audio signals to the receiver assembly by way of the contacts;

detecting, by the hearing device, that a device has been connected to the interface assembly in place of the receiver assembly;

measuring, by the hearing device, in response to detecting that the device has been connected to the interface assembly, an electrical characteristic of the device;

determining, by the hearing device, based on the electrical characteristic, that the device is a programming device;

reconfiguring, by the hearing device, in response to determining that the device is the programming device, the contacts to serve as input contacts;

receiving, by the hearing device, based on the reconfiguring of the contacts to serve as input contacts, programming instructions from the programming device by way of the contacts, the programming instructions including code configured to update at least one of a firmware and a fitting configuration of the hearing device; and updating, by the hearing device, based on the code included in the programming instructions, the at least one of the firmware and the fitting configuration of the hearing device.

15. The method of claim 14, wherein the electrical characteristic comprises at least one of a direct current resistance (DCR) of the device, an alternating current (AC) resistance of the device, a complex impedance of the device, and an electrical signal transmitted by the device.

16. The method of claim 14, wherein:

the configuring the contacts to serve as output contacts comprises configuring the contacts to serve as analog output contacts; and the reconfiguring the contacts to serve as input contacts comprises reconfiguring the contacts to serve as a digital data interface.

17. The method of claim 14, further comprising rebooting the hearing device; and wherein the detecting that the device has been connected occurs during a boot up phase of the hearing device.

18. The method of claim 14, wherein the hearing device is a receiver-in-canal (RIC) hearing device.

19. The method of claim 14, further comprising:

detecting, by the hearing device, that the receiver assembly has been disconnected from the interface assembly; and monitoring, by the hearing device, the interface assembly to detect that the device has been connected to the interface assembly in place of the receiver assembly.

20. The method of claim 14, further comprising:

detecting, by the hearing device, that a second device has been connected to the interface assembly in place of the programming device;

measuring, by the hearing device in response to detecting that the second device has been connected to the interface assembly, a second DCR of the second device;

determining, by the hearing device based on the second DCR, that the device is a second receiver assembly;

reconfiguring, by the hearing device in response to determining that the second device is the second receiver assembly, the contacts to serve as output contacts; and outputting, by the hearing device based on the reconfiguring of the contacts to serve as output contacts, audio signals to the second receiver assembly by way of the contacts.

* * * * *